United States Patent [19]

Asano et al.

[11] 4,141,679

[45] Feb. 27, 1979

[54] STRETCHING MACHINE

[75] Inventors: Toyohide Asano; Masahiro Honda, both of Ube, Japan

[73] Assignee: UBE Industries, Ltd., Japan

[21] Appl. No.: 863,171

[22] Filed: Dec. 22, 1977

Related U.S. Application Data

[62] Division of Ser. No. 740,089, Nov. 9, 1976, abandoned.

[30] Foreign Application Priority Data

Nov. 21, 1975 [JP] Japan ..... 50-139233

[51] Int. Cl.[2] ..... B29D 7/24

[52] U.S. Cl. ..... 425/445; 425/383; 264/DIG. 73; 425/DIG. 53

[58] Field of Search ..... 425/382, 383, 445, DIG. 53; 264/291, 167, 40.7, DIG. 73; 26/54

[56] References Cited

U.S. PATENT DOCUMENTS

| | | | |
|---|---|---|---|
| 2,389,292 | 11/1945 | Bjorksten | 264/DIG. 73 |
| 2,961,736 | 11/1960 | Kier | 425/383 X |
| 3,148,410 | 9/1964 | Laurie | 425/DIG. 53 |
| 3,319,294 | 5/1967 | Borsvald et al. | 425/445 |
| 3,762,147 | 10/1973 | Wuert | 425/445 X |
| 3,904,338 | 9/1975 | Straumanis | 264/40.7 X |
| 3,928,519 | 12/1975 | Kashiyama et al. | 264/167 X |
| 4,017,227 | 4/1977 | Schmidt | 425/445 X |

*Primary Examiner*—J. Howard Flint, Jr.
*Attorney, Agent, or Firm*—Paul & Paul

[57] ABSTRACT

A stretching machine for plastically straightening an extruded product from an extruding press is disclosed, in which a fixable tail stock and a cylinder operated slidable head stock provide the extruded product with a plastically straightened effect in an automatic operation. Means for variably adjusting the speed of the sliding movement of the head stock and means for automatically changing the sliding direction of the head stock are provided in the stretching machine. The method of operation of the stretching machine includes moving the head stock back toward the tail stock by a small amount after the extruded product has been plastically straightened so that the head stock can be easily disengaged from the extruded product.

3 Claims, 7 Drawing Figures

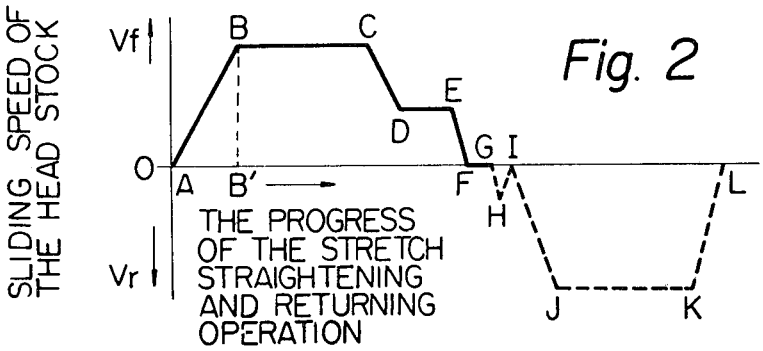
Fig. 2
Fig. 3
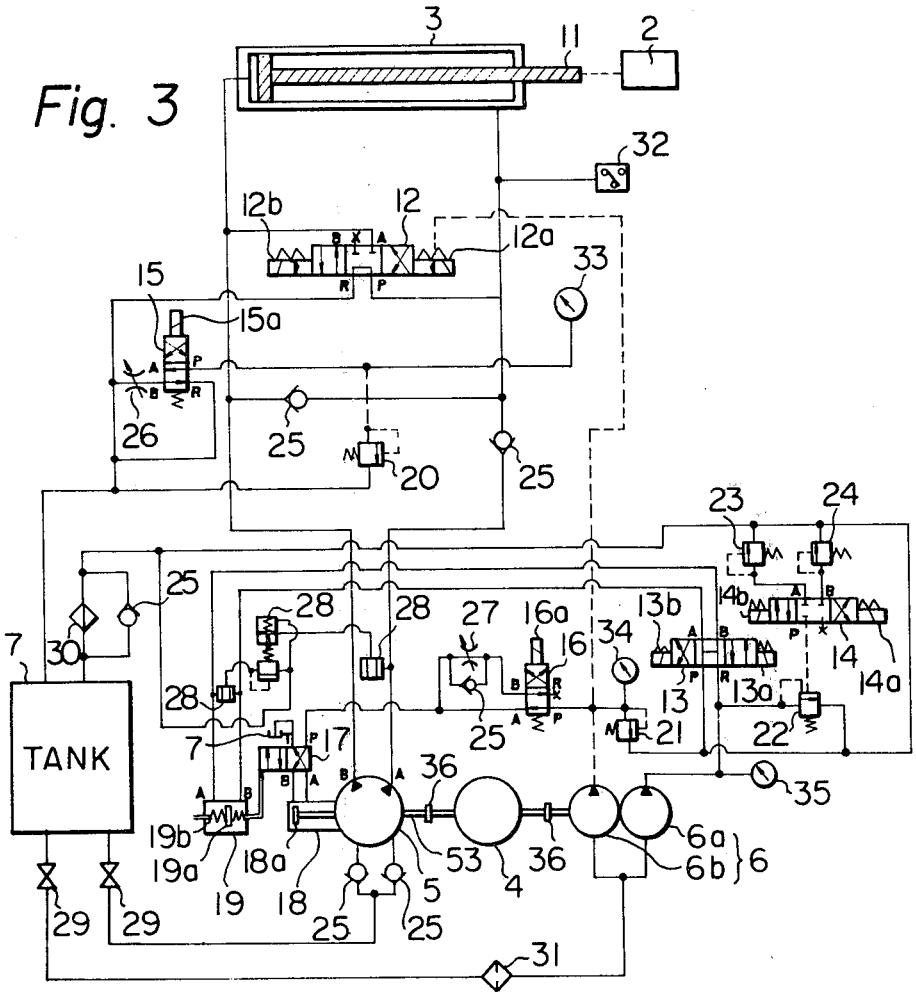

STRETCHING MACHINE

This is a division of application Ser. No. 740,089 filed Nov. 9, 1976, now abandoned.

DESCRIPTION OF THE INVENTION

The present invention relates to a stretching machine used with an extruding press.

It is known to use a stretching machine for providing an extruded product, particularly an elongated product extruded from an extruding press, with a physical stretch to plastically straighten the extruded product after the extruding process. This straightening of the extruded product will be referred to as "stretch straightening" throughout this specification. The stretching machine conventionally has a tail stock displaceably fixed on a longitudinal machine frame, and a head stock slidable on the machine frame either in a direction away from the tail stock or in the opposite direction toward the tail stock. Thus, when the stretch straightening operation is performed, an extruded product from an extruding press is loaded on the stretching machine so that the two opposite ends of the extruded product are fixed to the head and tail stocks. The fixed product is then subjected to stretch straightening due to the sliding movement of the head stock away from the tail stock. However, before starting the stretch straightening operation of the head and tail stocks, a sag or a downward curving of the fixed extruded product has always occurred due to the weight of the product, if the extruded product is long. Therefore, if the head stock is rapidly slid so as to cause a quick beginning of the stretch straightening of the extruded product, said product will cause a waving motion or flexing motion between the head and tail stocks. As a result, the extruded product touches or strikes the upper surface of the machine frame of the stretching machine during the waving motion, and can be damaged. Contrary to this, if the head stock is slowly slid so as to provide the extruded product with a slow stretch, it will take a long time to eliminate the sag of the extruded product and to bring about a take-up state of the extruded product before the starting of the stretch straightening operation. Consequently, the working efficiency of the stretching machine is in such case low. For the above two reasons, it is required that when the stretch straightening operation of the stretching machine is performed, the initial speed of the sliding movement of the head stock during the initial stage of the sag elimination operation is appropriately selected and adjusted in compliance with the size and shape of an extruded product until the sliding speed of the head stock is accelerated to a speed at which the head stock steadily slides so as to eliminate the entire sag of the extruded product.

In a conventional method, the initial sliding speed of a head stock of a stretching machine is, of course, selected to be an optimum value which is determined depending upon the size and shape of an extruded product. However, if the stretch straightening operation of the stretching machine is repeated in order to apply an equal straightening effect to many extruded products having an equal size and shape, the adjusting operation of the initial optimum sliding speed of the head stock must be achieved through repetitive manual adjustments of a four-way valve incorporated in a hydraulic drive circuit provided in the stretching machine. However, such manual adjustments of the four-way valve usually are inaccurate. As a result, the initial sliding speed of the head stock 2 is often different from the optimum sliding speed. Further, practised operators are needed for performing the switching operation so as to keep the deviation small. In addition, since the head and tail stocks of a stretching machine are always provided with a chuck, respectively, which grips an extruded product during the stretch straightening operation, it often occurs that the chuck of the head stock bites into the extruded product in response to the progress of the stretch straightening operation. Consequently, releasing of the chuck from the extruded product becomes difficult after completion of the stretch of the product. However, there has not been provided any simple and convenient method of and means for releasing the head stock chuck from the extruded product after the completion of the stretch straightening operation. This fact is very inconvenient from the view point of realizing automatic performance of the entire stretch straightening operation of a stretching machine from the gripping of an extruded product through the releasing of the head stock chuck from the extruded product.

An object of the present invention is, therefore, to provide an apparatus for controlling the operation of a stretching machine used with an extruding press, in which every defect and difficulty encountered by the conventional operation of a stretching machine can be obviated.

Another object of the present invention is to provide a controlling apparatus which allows the stretch straightening operation of an extruded product to be performed with high efficiency.

A further object of the present invention is to provided a stretching machine with means for carrying out a controlling method so that the stretching machine automatically repeats the stretch straightening operation without the necessity of any normal re-adjustment of the machine.

The present invention will become more readily apparent from the ensuring description of an embodiment with reference to the accompanying drawings wherein:

FIG. 2 is a diagram for illustrating the relationship between the amount and speed of the sliding movement of the head stock of the stretching machined of FIG. 1;

FIG. 3 is a diagram for illustrating a hydraulic circuit of the stretching machine of FIG. 1;

Figure 1:
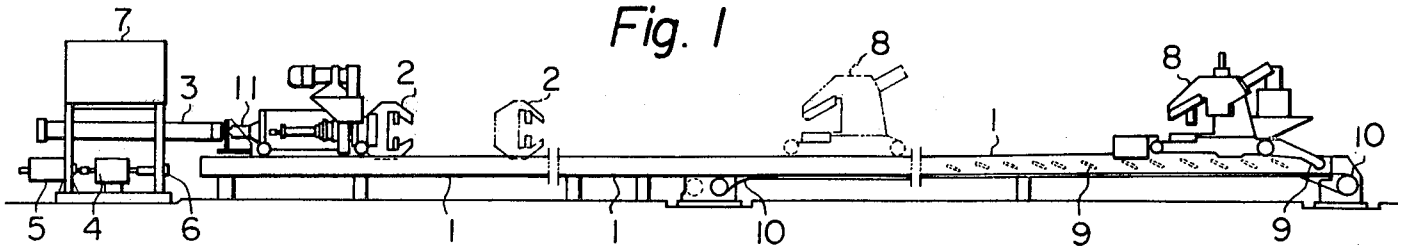
FIG. 1 is a front view of an embodiment of a stretching machine.

Referring to FIG. 1, a stretching machine is shown, which comprises a longitudinal machine frame 1, a head stock 2 slidably mounted on the machine frame 1, a hydraulic cylinder 3 for actuating the sliding movement of the head stock 2, an electric drive motor 4, a variable displacement type hydraulic pump 5 driven by the electric drive motor 4 and driving the cylinder 3, a hydraulically operated pump 6 driven by the electric drive motor 4, a tank 7 for receiving a hydraulic fluid, a tail stock 8 displaceably fixed on the machine frame 1, a plurality of stops 9 provided on the machine frame 1 for fixing the tail stock 8 at diverse positions on the machine frame 1, and a chain drive 10 for adjusting the position of the tail stock 8 on the machine frame 1. When the stretching machine is operated to effect a stretch straightening for an extruded product from an extruding press (not shown), the position of the tail stock 8 is initially adjusted and fixed on the machine frame 1 in compliance with the actual length of the extruded product. Subsequently, the extruded product (not shown) is loaded on the stretching machine so that the two opposite ends of the product are fixed to the head and tail stocks 2 and 8. Then, the sliding movement of the head stock 2 away from the tail stock 8 is commenced by the hydraulic cylinder 3, which is operated by the pump 5, so that the stretch straightening of the extruded product is initiated. That is, referring to FIG. 1, the slide of the head stock 2 to the left is initiated with the left end of the extruded product being gripped by said head stock 2. Thus, after the head stock 2 is accelerated to an appropriate sliding speed, the operation to eliminate the sag of the extruded product occurring between the two heads 2 and 8 is carried out under a constant sliding speed of the head stock 2, and is continued until the extruded product reaches its take-up state without any sag remaining. After the extruded product reaches its take-up state due to elimination of the sag, further sliding movement of the head stock 2 toward the left in FIG. 1 provides the extruded product with a stretch straightening effect. The sliding speed of the head stock 2 is adjusted so as to correspond to, for example, a speed diagram as shown in FIG. 2.

In FIG. 2, the abscissa shows the progress of the stretch straightening operation from the initial start of the sliding movement of the head stock 2 to the completion of the stretch straightening of the extruded product and also the progress of the returning operation of the head stock 2 to the initial starting position. The ordinate of FIG. 2 shows the sliding speed of the head stock 2 during both the stretch straightening and returning operations of the head stock 2. It should be understood that the sliding speed $V_f$ during the stretch straightening operation is shown in the upper part above the abscissa axis, and the sliding speed $V_r$ during the returning operation is shown in the lower part below the abscissa axis. That is, the solid line from point A through point F indicates the change in the sliding speed of the head stock 2 during the sag elimination and stretch straightening operations, while the broken line from point G through point L indicates the change in the slidingd speed of the head stock 2 during the returning operation. In the diagram of FIG. 2, the sliding speed of the head stock 2 between the points B and C indicates a speed referred to as the "take-up speed", at which the head stock 2 carries out the sliding movement toward the left in FIG. 1 so as to continue the sag elimination of the extruded product gripped by the head stock 2 and the fixed tail stock 8. Therefore, when the amount of the sliding movement of the head stock 2 reaches the point C, the extruded product is in the take-up state without any sag remaining. The sliding speed of the head stock 2 between the points D and E indicates a speed at which the stretch straightening of the extruded product is effected. Further, the sliding speed of the head stock 2 between the points J and K indicates a speed at which the head stock 2 returns to its initial starting position. As an example, the speeds at which the sag eliminating operation, the stretch straightening operation and the head stock returning operation are performed, respectively, may be selected as 100 through 150 mm/sec, approximately 30 mm/sec, and 200 through 300 mm/sec, respectively. The slanted line between the points A and B in the diagram of FIG. 2 indicates how the head stock 2 is initially accelerated during the initial stage of the sag elimination operation from its starting position to the position where the head stock 2 begins to stretch the extruded product so as to eliminate the sag of said product under a constant sliding speed. That is, the slant of the line between the points A and B is an initial acceleration of the head stock 2. The point H indicates a maximum speed of the head stock 2 while said head stock returns by small amount of movement toward the initial position when the stretch straightening operation is completed, and when the head stock 2 is disengaged from the extruded product 2. It should be noted that this small amount of returning of the head stock 2 is performed so as to release a chucking device of the head stock 2 from the extruded product with certainty, since the chucking device of the head stock 2 has firmly bitten into the end of the extruded product during the stretch straightening operation. In the diagram of FIG. 2, the area enclosed by the three points A, B and B' indicates the time required for the head stock 2 to be accelerated to the speed at which the head stock 2 steadily slides to completely eliminate the sag of the extruded product. Therefore, it will be understood that if the initial acceleration of the head stock 2 is set to be considerably smaller than that shown by the slant of the line between the points A and B, it takes a long time for the head stock 2 to be accelerated to the speed at which said head stock 2 slides steadily to eliminate the sag. As a result, the working efficiency of the stretching machine becomes low. On the other hand, if the initial acceleration of the head stock 2 is set to be larger than that show by the slant of the line between the points A and B, it will take a short time for the head stock 2 to be accelerated to the speed at which said head stock 2 steadily slides until the sag of the extruded product is completely eliminated. However, in the case of an extremely high acceleration of the head stock 2, a waving motion of the extruded product will occur during the initial stage of the sag elimination operation, and thus, the extruded product will be damaged when said product contacts the machine frame 1 (FIG. 1) during the waving motion. Consequently, the initial acceleration of the head stock 2 indicated by the slant of the line between the points A an B must be appropriately adjusted depending upon the size and shape of the extruded product to be subjected to the stretch straightening operation by the stretching machine. It will be understood from the description mentioned later that in accordance with the present invention, an appropriately adjusted initial acceleration of the head stock 2 can be automatically maintained during the repetitive stretch straightening operations for many equal extruded products.

Referring now to FIG. 3 illustrating a hydraulic drive circuit for the head stock 2, a front end of a piston rod 11 of the cylinder 3 is attached to the head stock 2. The reference numerals 4 though 7 indicate the same elements as shown in FIG. 1, however, *6a* and *6b* designate a pilot pump part and a servo pump part incorporated in the hydraulically operated pump 6. As shown in FIG. 3, the electric motor 4 is associated with the variable displacement type hydraulic pump 5, the pilot pump part *6a*, and the servo pump part *6b*, respectively, so as to drive these three pumps. The reference numerals 12 through 16 individually indicate electro-magnetic or solenoid-operated four-way valves. The reference numeral 17 indicates a hydraulic four-way valve for use in causing a variation in the displacement of the pump 5. A solenoid 12*a* of the valve 12 is energized when the piston rod 11 is drawn into the cylinder 3 so as to cause the sliding movement of the head stock 2 for providing the extruded product with a stretch effect. A solenoid 12*b* of the valve 12 is energized when the piston rod 11 is pushed out of the cylinder 3 so as to slightly move the head stock 2 toward the initial starting position thereby facilitating the release of the chucking device of the head stock 2 from the extruded product. A solenoid 13*a* of the valve 13 is energized when the stretch straightening of the product is performed. A solenoid 13*b* of the valve 13 is energized when the cylinder 3 is actuated so as to return the head stock 2 toward its initial starting position. A solenoid 14*a* of the valve 14 is energized while the head stock 2 stretches the extruded product so as to eliminate the sag of said product, thereby acquiring the take-up state of the extruded product. A solenoid 14*b* of the valve 14 is energized when the stretch straightening of the product is performed. A solenoid 15*a* of the valve 15 is energized when the cylinder 3 is actuated to return the head stock 2 to its initial starting position. A solenoid 16*a* of the valve 16 is energized when a servo valve 18 of the pump 5 is operated. The servo valve 18 has a servo piston 18*a*, the axial movement of which causes the switching of the discharge ports of the pump 5 from A to B or vice versa. The axial movement of the servo piston 18*a* also causes a change in the displacement of the pump 5. The reference numeral 19 designates a pilot valve having a pilot piston 19*a* which moves in the axial direction depending upon the magnitude of the pilot pressure supplied from the pilot pump 6*a*. The axial movement of the pilot piston 19*a* causes the switching of the hydraulic four-way valve 17 which actuates the servo piston 18*a* of the servo valve 18. The reference numeral 19*b* designates a compression spring incorporated into the pilot valve 19. The detailed constructions of the hydraulic four-way valve 17, the servo valve 18 and pilot valve 19 will be later described with reference to FIG. 4. Reference numerals 20 through 24 of FIG. 3 designate relief valves. The relief valve 20 is arranged so as to regulate the maximum hydraulic pressure in the hydraulic circuit of FIG. 3. The relief valve 21 is arranged so as to regulate the servo pressure in the hydraulic circuit of FIG. 3. The relief valve 22 is arranged so as to regulate the hydraulic pressure under which the cylinder 3 operates to return the head stock 2 toward its initial starting position. The relief valve 23 is arranged so as to regulate the hydraulic pressure under which the stretch straightening of the extruded product is performed by the head stock 2. The relief valve 24 is arranged so as to regulate the hydraulic pressure under which the sag elimination of the extruded product is performed by the head stock 2. The hydraulic pressure regulated by the relief valves 20 may be selected to be, for example, 210 kg/cm$^2$. The hydraulic pressures regulated by the relief valves 21 and 23 may be selected to be, for example, 15 kg/cm$^2$. The hydraulic pressures regulated by the relief valves 22 and 24 may be selected to be, for example, 45 kg/cm$^2$. Reference numeral 25 designates check valves arranged in diverse positions of the hydraulic circuit of FIG. 3. Reference numeral 26 designates a variable choke valve. Reference numeral 27 designates a flow control valve for adjusting the speed of varying the displacement of the pump 5. Reference numeral 28 is a torque constant valve acting as a safety valve to prevent the electric motor 4, for driving the pumps 5 and 6, from being over-loaded. Reference numeral 29 designates valves for opening and closing the circuits between the tank 7 and the pump 5 and between the tank 7 and the pump 6. 30 is an oil cooling element. 32 is a pressure switch for use in detecting that the extruded product has reached its take-up state. Reference numeral 33 through 35 designate pressure gages. An element designated by reference numeral 36 is a mechanical coupling. It should be noted that the hydraulic four-way valve 17 and the flow control valve 27 are arranged in series between the servo valve 18 for the pump 5 and the servo pump part 6*b* of the pump 6, so that the servo piston 18*a* of the servo valve 18 is slowly operated at the beginning of the operation to provide the extruded product with a stretch effect. That is to say, the slow movement of the servo piston 18*a* can cause a slow variation in the displacement of the pump 5. Therefore, the cylinder 3 is slowly operated so as to slowly slide the head stock 2. The adjustment of the operating speed of the servo piston 18*a* is, of course, attained by adjusting the flow control valve 27.

Figure 4:
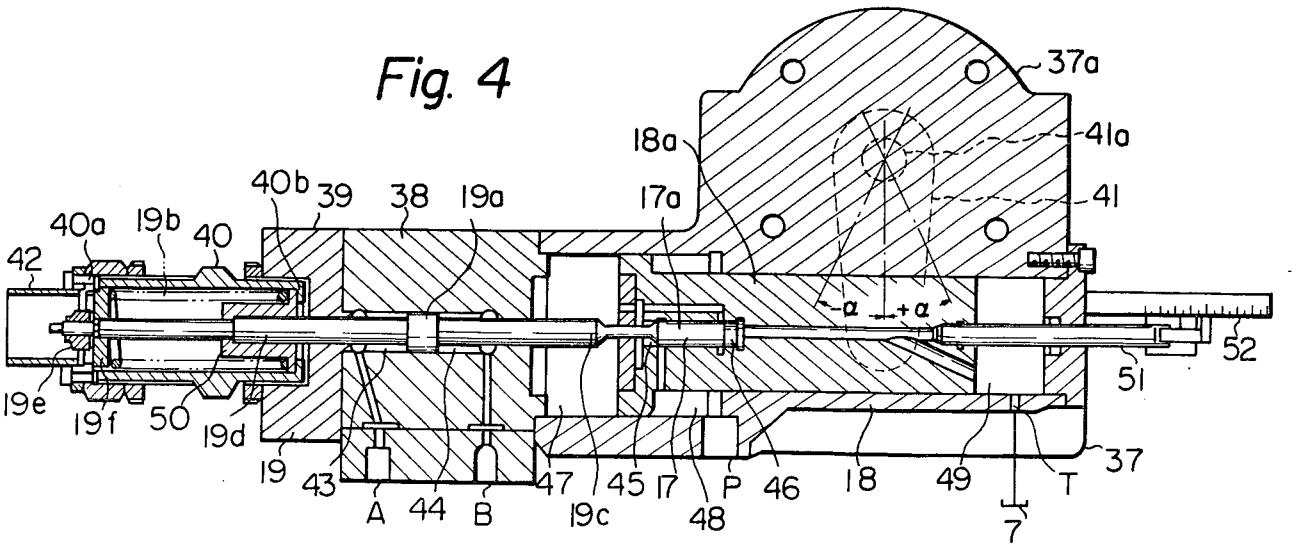
FIG. 4 is a cross-sectional view of a valve means employed in the hydraulic circuit of FIG. 3.

FIG. 4 shows a regulator 37 which acts as a valve means and is associated with the variable displacement type hydraulic pump 5. The regulator 37 is constructed so as to incorporate therein the hydraulic four-way valve 17, servo valve 18, pilot valve 19 and some other elements. In the construction of the regulator 37, 37*a* is a regulator casing, 38 is a piston casing of the pilot valve 19, 18*a* is a servo piston and 19*a* is a pilot piston. 19 is a front covering of the regulator 37, 40 is a neutral position retaining device described later, 41 is a swingable lever having an end connected to the servo piston 18*a*, 19*b* is a compression spring, 42 is a casing and 7 is the oil tank. The pilot piston 19*a* is a double rod type piston slidably fitted in chambers 43 and 44 of the piston casing 38. One rod 19*c* of the pilot piston 19*a* has an end integrally connected to a piston 17*a* of the hydraulic four-way valve 17. The piston 17*a* is in turn slidably fitted in chambers 45 and 46 formed in the servo piston 18*a*. The servo piston 18*a* is slidably fitted in chambers 47, 48 and 49 formed in the regulator casing 37*a*. In FIG. 4, reference letters A and B designate two ports of the pilot valve 19, and reference letters P and T designate two ports of the hydraulic four-way valve 17. The movement of the piston 17*a* causes an interconnection and interruption between chambers 45 and 48, and between chambers 45 and 46. The chambers 45 and 47 and the chambers 46 and 49 are always interconnected. The other rod 19*d* of the pilot piston 19*a* has an end to which a stop nut 19*e* and a spring seat 19*f* are attached. Another spring seat 50 is attached to a middle portion of the rod 19*d*. A compression spring 19*b* is disposed between the two spring seats 19*f* and 50 within the neutral position retaining device 40, so that the pilot piston 19*a* and the piston 17*a* are normally positioned by the action of the spring 19*b* at their neutral positions. When the pilot piston 19*a* and the piston 17*a* are positioned at their neutral positions, the chambers 48 and 45, and the chambers 45 and 46 are both interrupted. However, as soon as the piston 17*a* is moved in one direction from its neutral position, either chambers 48 and 45 or chambers 45 and 46 are interconnected. 40*a* and 40*b* are stop plates for the spring seats 19*f* and 50, respectively.

The operation of the regulator 37 will be described hereinafter with reference to FIGS. 3 and 4.

When the piston 17*a* is positioned at its neutral position as shown in FIG. 4, and when the solenoid 13*a* (FIG. 3) is energized, a pressurized pilot fluid from the pilot pump 6*a* is supplied to the port A of the pilot valve 19. As a result, the pilot piston 19*a* is pushed by the pressurized pilot fluid toward the right in FIG. 4 against the spring force of the compression spring 19*b*. The movement of the pilot piston 19*a* causes the same rightward movement of the piston 17*a* thereby establishing the interconnection between the chamber 48 and both chambers 45 and 47. At this stage, since a pressurized fluid from the servo pump 6*b* is led to the port P of the servo pump 6*b* through the electro-magnetic four-way valve 16, and since the chamber 47 separated from the chamber 48 by the servo piston 18*a* has a cross-sectional area larger than that of said chamber 48, the servo piston 18*a* starts to move toward the right in FIG. 4. The movement of the servo piston 18*a* is continued until the chamber 48 is disconnected from the chamber 45 by the piston 17*a*, and also until the chamber 45 is disconnected from the chamber 46 by the piston 17*a*. That is to say, the neutral position of the piston 17*a* as shown in FIG. 4 is again established. It should be noted that during the above-mentioned movements of the pilot piston 19*a* toward the right in FIG. 4, a fluid within a chamber 44 is discharged from the port B and also that during the above-mentioned movement of the servo piston 18*a*, a fluid within a chamber 49 is discharged from the port T of the regulator 37. As will be understood from the foregoing, the movement of the servo piston 18*a* toward the right in FIG. 4 causes a swinging motion of the lever 41 in the counterclockwise direction of FIG. 4 about a pivot 41*a*, thereby causing a change in the displacement amount of the pump 5 (FIG. 3). That is, a predetermined amount of a pressurized fluid is fed out from the port A of the pump 5. As a result, as will be understood from FIG. 3, the piston rod 11 of the cylinder 3 is moved toward the left in FIG. 3 and the head stock 2 is pulled by the piston 11 so as to slide in the direction away from the tail stock 1 (FIG. 1). It should now be understood that if the pressure of the pressurized pilot fluid is changed, the amount of movement of the servo piston 18*a* can be changed. As a result, the amount of the swinging motion of the swing lever 41 is also changed. Therefore, if the pressure of the pressurized pilot fluid from the pilot pump 6*a* is changed, the amount of the displacement of the pump 5 can be changed, and thus, the speed of the movement of the piston rod 11 of the cylinder 3 can be changed. When the pressurized fluid from the pilot pump 6*a* is fed to the pilot valve 19 through the port B in FIG. 4, the pilot piston 19*a* will be moved toward the left in FIG. 4 while pulling the piston 17*a*. As a result, the chamber 47 is connected to the chamber 46 through the chamber 45 of the servo piston 18*a*. Therefore, the pressurized fluid is released from the chamber 47 through the chambers 45 and 46 into the chamber 49. Thus, the fluid pressure acting on the servo piston 18*a* within the chamber 47 decreases and, consequently, the servo piston 18*a* is moved to the left in FIG. 4. This leftward movement of the servo piston 18*a* causes the swinging motion of the swingable lever 41 in the clockwise direction in FIG. 4 about the pivot 41*a*. When the swingable lever 41 swings in the clockwise direction in FIG. 4, the variable displacement type hydraulic pump 5 discharges pressurized fluid through the port B thereof (FIG. 3), which fluid is fed to the cylinder 3 so as to move the piston rod 11 and the head stock 2 toward the right in FIG. 3. That is, the head stock 2 is returned toward the tail stock 8. The returning speed of the head stock 2 can be changed by changing the pressure of the pressurized pilot fluid supplied to the pilot valve 19 from the pilot pump 6*a*. It should be noted that a reference numeral 51 is a movable lever attached to the servo piston 18*a*, and that a reference numeral 52 designates a scale cooperating with the movable lever 51. The scale 52 is fixed to the regulator 37. Thus, the amount of the movement of the servo piston 18*a* and the variation in the displacement of the pump 5 are indicated by the cooperation of the lever 51 and the scale 52.

When the head stock 2 initially commences to perform the stretch straightening of an extruded product after gripping the extruded product, the pressurized fluid from the servo pump 6*b* is fed to the port P of the hydraulic switch valve 17 by way of the flow control valve 27 constructed as a choke valve. That is, at the start of the stretch straightening operation, the electromagnetic four-way valve 16 is energized. Therefore, the port P of the valve 16 (FIG. 3) is interconnected with the port B of said valve 16. Thus, the pressurized fluid from the servo pump 6*b* is fed to the hydraulic four-way valve 17 through the flow control valve 27. It should, of course, be understood that by appropriately adjusting the opening of the flow control valve 27, it is possible to keep constant the speed at which the pressure of the fluid from the servo pump 6*b* begins to act on the two valves 17 and 18 at the start of the stretch straightening operation. The adjustment of the opening of the flow control valve 27 may be manually, or if preferable automatically, performed. If the opening of the flow control valve 27 is large, the movement of the servo piston 18*a* will be quick. On the other hand, if the opening of the flow control valve 27 is small, the movement of the servo piston 18*a* will be slow. Therefore, by adjusting the opening of the flow control valve 27, the speed of the change in the amount of the displacement of the pump 5 can be adjusted. As a result, the starting speed of the movement of the piston rod 11 of the cylinder 3 is also adjusted. This fact means that at the start of the stretch straightening operation, the speed of the sliding of the head stock 2 is easily adjusted depending upon the size and shape of an extruded product to be plastically straightened. It should be understood that if an extruded product has such a size and shape that the rigidness of said product is great, the starting speed of the head stock 2 can be relatively quick.

Figure 5:
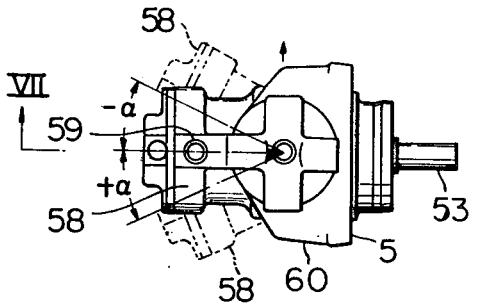
FIG. 5 is a plan view of an example of a hydraulic pump used in the hydraulic circuit of FIG. 3.
Figure 6:
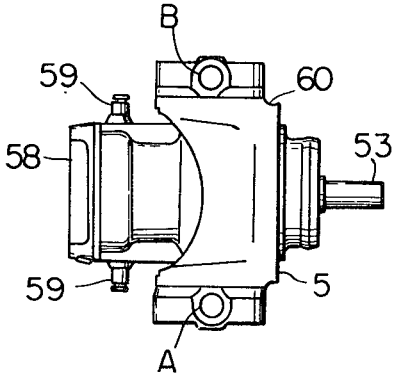
FIG. 6 is a front view of the hydraulic pump of FIG. 5.
Figure 7:
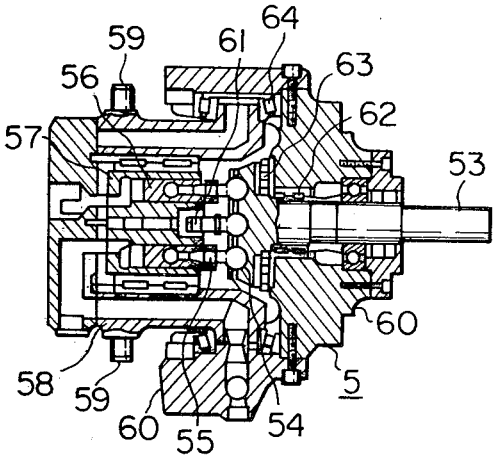
FIG. 7 is a cross-sectional view taken along the line VII—VII of FIG. 5.

Referring now to FIGS. 5 through 7, an axial plunger pump, used as an example of the variable displacement type hydraulic pump 5, is shown. The axial plunger pump has a drive shaft 53 connected at its one end to the electric motor 4 (FIGS. 1 and 3). The other end of drive shaft 53 is integrally connected to a flange 54. 55 designates a plurality of plungers disposed at positions equally distant from the central axis of the flange 54. Each plunger 55 has a piston 56 which is housed in a cylinder block 57 and is slidable in the axial direction. The cylinder block 57 is encased in a cylinder casing 58 which has shafts 59 attached to both sides thereof. 60 is a casing, 61 is a pushing rod disposed between the flange 54 and the cylinder block 57 at the center of the pump, 62 is a radial bearing, 63 is a thrust bearing and 64 is a bearing about which the cylinder casing 58 can be swung from the position shown by a solid line to the positions showns by phantom lines in FIG. 5. The swing of the cylinder casing 58 is actuated by the swingable lever 41 (FIG. 4) which is attached to the shafts 59 when the axial plunger pump is mounted on the stretching machine of FIG. 1. During the rotation of the drive shaft 53, if the cylinder casing 58 is swung to one of the positions shown by the phantom lines, a port through which a pressurized fluid is discharged is switched from A to B or vice versa. That is to say, the axial plunger pump of FIGS. 5 through 7 has two ports A and B, as shown in FIG. 6. It should be understood that the amount of the displacement of the axial plunger pump is changed depending upon the magnitude of the swinging angle $\alpha$ from the position shown by the solid line in FIG. 5.

In accordance with the present invention, the following effects are acquired in the stretch straightening of an extruded product.

(1) Since the sliding speed of a head stock of a stretching machine at the start of the stretch straightening operation is easily and appropriately adjusted depending upon the size and shape of an extruded product, the waving motion of the extruded product, which may cause damage to the extruded product, is not caused during the sag elimination process.

(2) The stretch straightening of many equal extruded products is efficiently performed, since the initial sliding speed of a head stock of a stretching machine can be set at an optimum fixed valve by adjusting the opening of a flow control valve for use in adjusting the amount of the displacement of a variable displacement type hydraulic pump for driving a cylinder which actuates the head stock.

(3) The releasing of a head stock from an extruded product can easily and surely attained at the completion of the stretch straightening of the extruded product, since the releasing operation is performed after the head stock is moved back toward the direction opposite to the direction in which the head stock is moved to provide the extruded product with a physical stretch.

(4) The entire stretch straightening operation from the start of the sliding of the head stock to the returning of the head stock can be automatically performed by the stretching machine in accordance with the present invention.

We claim:

1. A stretching machine for plastically straightening an extruded product from an extruding press, comprising:

a longitudinal machine frame fixed on a base arranged adjacent to the extruding press;

a fixible tail stock arranged on the machine frame for gripping an end of said extruded product;

a head stock slidable on the machine frame in one of the directions toward and away from said tail stock, said head stock gripping the other end of said extruded product;

a cylinder having a movable piston rod associated with said head stock for actuating a sliding movement of said head stock;

a hydraulic circuit including a variable displacement hydraulic pump for supplying said cylinder with a hydraulic fluid acting on the piston rod;

means for variably adjusting the speed of the sliding movement of said head stock, and;

means for automatically changing a sliding direction of said head stock, wherein said adjusting means of the sliding speed of said head stock comprises means for regulating the flow of the hydraulic fluid discharged from said variable displacement hydraulic pump toward said cylinder, said valve means being arranged in said hydraulic circuit.

2. A stretching machine as claimed in claim 1, wherein said regulating means comprises a hydraulic servo valve to regulate the flow of the hydraulic fluid discharged from said variable displacement hydraulic pump, a hydraulic valve arranged between a hydraulic servo pump and said hydraulic servo valve, and a flow control valve arranged between said hydraulic servo pump and said hydraulic valve.

3. A stretching machine as claimed in claim 1, wherein said changing means comprises electro-magnetic four-way valves arranged in said hydraulic circuit for changing the flow direction of said hydraulic fluid from said variable displacement hydraulic pump to said cylinder, said four-way valves being sequentially energizable in response to the progress of the operation of said stretching machine from the starting of said sliding movement of said head stock away from said tail stock to the returning of said head stock toward said tail stock.

* * * * *

UNITED STATES PATENT OFFICE

CERTIFICATE OF CORRECTION

Patent No. 4,141,679 Dated February 27, 1979

Inventor(s) Toyohide Asano and Masahiro Honda

It is certified that error appears in the above-identified patent and that said Letters Patent are hereby corrected as shown below:

In Column 2, line 13 after the word "stretch" and before the word "of" insert therefore -- straightening --

In Column 2, line 33 after the word "to" delete "provided" and insert therefore -- provide --

In Column 2, line 37 after the word "any" delete "normal" and insert therefore -- manual --

In Column 2, line 46 after the word "stretching" delete "machined" and insert therefore -- machine --

In Column 3, line 48 after the word "the" delete "slidingd" and insert therefore -- sliding --

In Column 6, line 32 second occurrence, first word of the sentence delete "19" and insert therefore -- 39 --

Signed and Sealed this

*Third* Day of *July 1979*

[SEAL]

*Attest:*

*Attesting Officer*

LUTRELLE F. PARKER

*Acting Commissioner of Patents and Trademarks*